US006360645B1

(12) United States Patent
McNulty, Jr. et al.

(10) Patent No.: US 6,360,645 B1
(45) **Date of Patent: *Mar. 26, 2002**

(54) UNCHAMBERED AMMUNITION FOR USE WITH NON-LETHAL ELECTRICAL DISCHARGE WEAPONS

(76) Inventors: James F. McNulty, Jr., 1290 3rd St., Calimesa, CA (US) 92320; John F. Chudy, 35728 Ave. G, Yucaipa, CA (US) 92399

( * ) Notice: Subject to any disclaimer, the term of this patent is extended or adjusted under 35 U.S.C. 154(b) by 0 days.

This patent is subject to a terminal disclaimer.

(21) Appl. No.: 09/610,846

(22) Filed: Jul. 5, 2000

(51) Int. Cl.[7] ..... B64D 1/04
(52) U.S. Cl. ..... 89/1.11
(58) Field of Search ..... 89/1.11

(56) References Cited

U.S. PATENT DOCUMENTS 5,654,867 A * 8/1997 Murray ..... 361/232
5,831,199 A * 11/1998 McNulty, Jr. et al. ..... 89/1.11
6,053,088 A * 4/2000 McNulty, Jr. ..... 89/1.11

* cited by examiner

*Primary Examiner*—Charles T. Jordan
*Assistant Examiner*—Jordan Lofdahl
(74) *Attorney, Agent, or Firm*—Leonard Tachner

(57) ABSTRACT

An addition device which permits a user of a close proximity electrical discharge weapon to modify his or her weapon by providing a long range capability which can be added as an after-market improvement. In a preferred embodiment illustrated and described herein, the original close proximity device is a hand-held plastic device having a pair of extending contact probes for disabling a nearby perpetrator. The invention is an apparatus designed to be mechanically and electrically attached to the device and provides an unchambered wire-tethered dart cartridge which extends above the weapon and gives the user the additional capability of contacting long range targets. The apparatus permits easy and convenient replacement of spent cartridges as well as easy and convenient connection to and disconnection from the close proximity device.

11 Claims, 4 Drawing Sheets

UNCHAMBERED AMMUNITION FOR USE WITH NON-LETHAL ELECTRICAL DISCHARGE WEAPONS

BACKGROUND OF THE INVENTION

1. Field of the Invention

The present invention relates generally to the field of non-lethal, electrical discharge weapons such as TASER® devices and more specifically to an unchambered ammunition round designed to be added to such weapons of a close proximity type to provide long range capability by converting the weapon to a firearm.

2. Prior Art

Electrical discharge weapons have become fairly commonplace in recent years. Numerous U.S. patents have issued for invention of such weapons and for their further improvement. U.S. Pat. No. 3,523,538 issued to Shimzu on Aug. 11, 1970; U.S. Pat. No. 3,803,463 issued to Cover on Apr. 9, 1974; U.S. Pat. No. 4,253,132 issued to Cover on Feb. 24, 1981; U.S. Pat. No. 5,473,501 issued to Claypool on Dec. 5, 1995; U.S. Pat. No. 5,654,867 issued to Murray on Aug. 5, 1997; U.S. Pat. No. 5,698,815 issued to Ragner on Dec. 16, 1997; and U.S. Pat. No. 6,053,088 issued to McNulty on Apr. 25, 2000. They provide an effective but non-lethal form of self-defense which may be legally carried on one's person for safety. They have also been used extensively in law enforcement. Generally, there are two types of such weapons, namely, those designed for use in close proximity to another and those having a relatively long range, i.e., 10 feet or more. The close proximity weapons typically have two separated electrodes affixed to the weapon. The weapon must be moved toward a perpetrator so that the electrodes contact the target at two spaced-apart locations. Trained operators can apply the weapon electrodes with precision to the most responsive areas of the target anatomy. The long range weapons usually are firearms that provide two launchable, wire-tethered conductive darts which are propelled at a fixed angle from each other by gun powder to a remote target some distance away. If the two darts contact the perpetrator, the discharge through the wire tethers and the darts will disable the target. Each of these types of weapons has its respective advantages. For example, the close proximity weapon is more effective in situations where a perpetrator is already in contact with the weapon's user such as in surprise attack scenarios or for potential robbery victims within reach of a threatening perpetrator. On the other hand, where time and distance permit, a long range weapon can be very effective before a perpetrator gets too close to the user. With close proximity perpetrators, a loss of distance between the long range weapon's opposed contacts at the target is observed to jeopardize weapon effectiveness. Precision application of the longer range weapon's contacts to more responsive areas of the target anatomy to overcome any such loss of effectiveness is unlikely.

There are some firearms available which have both long range and close proximity capability. They have a dart cartridge and a pair of attached "feeler probes" with two switches permitting actuating one or the other. However, these weapons are only available if purchased with this dual function capability to start with. There is at least one prior art firearm which permits a user, who already possesses a close proximity unit, to add a long range capability to that unit as an after-market addition. This weapon however, has a chamber which must be loaded with separate ammunition cartridges.

Before the appearance of electrical discharge weapons, fixed ammunition cartridges were chambered within a portion of the bore(s) of firearms where they were exposed to a detonating action, usually consisting of a hammer and a firing pin. Fouling from ammunition discharges within the chambers threatened to do little more than modestly accelerate the normal wear of mechanisms and components, and this wear could be greatly reduced by cleaning regimens. However, by ATF Rule 80-20, the United States Secretary of Treasury allowed the manufacture of a unique pistol known as a TASER®. As manufactured, the TASER® firearm chambers its fixed ammunition cartridges in its receiver where, uniquely, it exposes the ammunition to a detonating action consisting of two opposed electrodes that pass a high tension electrical current through the ammunition's charge (s). Fouling of the TASER®'s chamber(s) from ammunition discharges threatens the function of the TASER®'s electrical means for detonating ammunition. Sufficient build up of carbon and other electrically conductive residues left on chamber surfaces after firings can short or track the high voltage currents between the electrodes along chamber surfaces rather than through the more resistive ammunition charge, thereby, causing weapon misfires.

SUMMARY OF THE INVENTION

The present invention is an addition device which permits a user of a close proximity electrical discharge weapon to modify his or her weapon to a firearm and provide a long range capability which can be added as an after-market improvement. In a preferred embodiment illustrated and described herein, the original close proximity device is a hand-held plastic device having a pair of extending contact probes for disabling a nearby perpetrator. The invention is an apparatus designed to be mechanically and electrically attached to the device and provides an unchambered wire-tethered dart cartridge which extends above the weapon and gives the user the additional capability of contacting long range targets. The apparatus permits easy and convenient replacement of spent firearm's ammunition cartridges as well as easy and convenient connection to and disconnection from the close proximity device.

The present invention avoids chamber-related build-up by eliminating the TASER®'s chamber(s) and, therefore, the substrate for conductive residue paths. The invention consists of a fixed ammunition cartridge with a shot containing bore positioned ahead of the ammunition's charge(s), and means for affixing the ammunition cartridge to the exterior surface of the TASER® firearm's receiver or frame where the ammunition is exposed to a detonating current or means for affixing the ammunition cartridge directly to opposed electrode(s) exposed at the exterior surface of the TASER®. This invention also eliminates the need for including a chamber within the TASER® receiver with the obvious benefits of reduced weapon girth and weight, manufacturing cost, ease of loading and reloading. Also, the fact that the weapon is loaded with live ammunition rounds is not concealed from the shooter thus averting accidents.

OBJECTS OF THE INVENTION

It is therefore a principal object of the present invention to provide an apparatus for addition to a close proximity electrical discharge weapon to add a long range capability to the weapon by converting it to a firearm.

It is another object of the invention to provide an after-market device which permits users of close proximity electrical discharge weapons to add a long range wire-tethered dart system to their weapons.

It is still another object of the invention to provide an improved combination of close proximity electrical discharge weapon and wire-tethered dart long range electrical discharge weapon.

It is still another object of the invention to provide a method for modifying a close proximity electrical discharge weapon to give the weapon a long range capability.

It is yet another object of the invention to provide an ammunition cartridge for TASER® firearms which may be fired unchambered.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Referring to the accompanying drawings, it will be seen that weapon 10 in accordance with a preferred embodiment of the preferred embodiment of the present invention, comprises a hand-held electrical discharge short range or direct contact weapon 12 and a cartridge 14 which has been added to weapon 12 to provide long range or remote contact capability.

Figure 3:
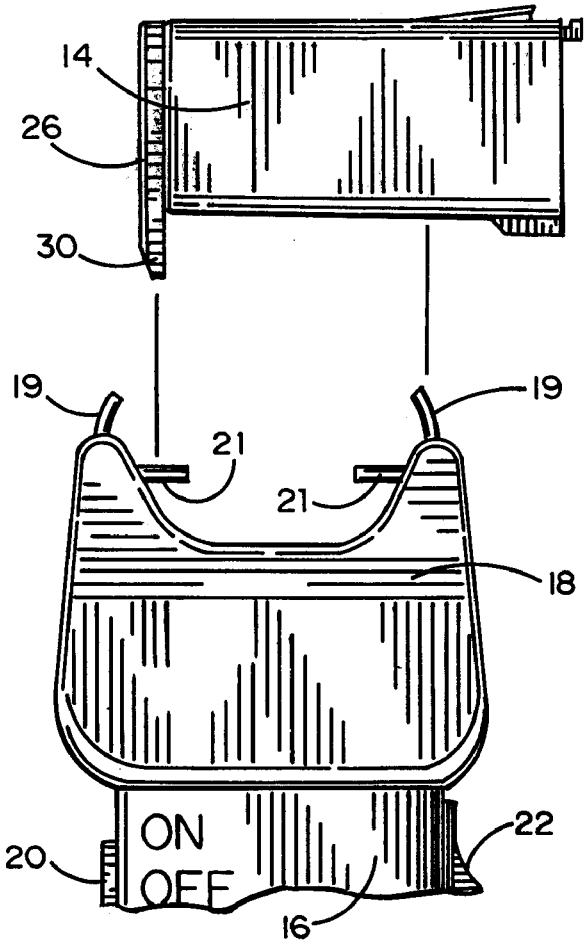
FIG. 3 is an elevational view similar to FIG. 2, but showing the unchambered ammunition cartridge removed to a position above the electrodes for use of the weapon in its short range operational mode.
Figure 4:
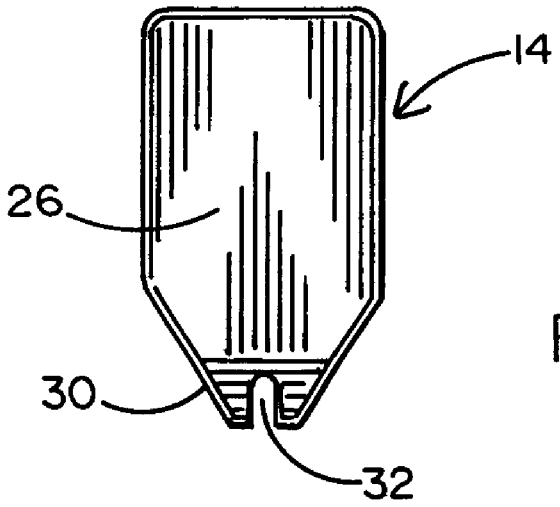
FIG. 4 is a rear view of the unchambered ammunition cartridge of the invention.
Figure 5:
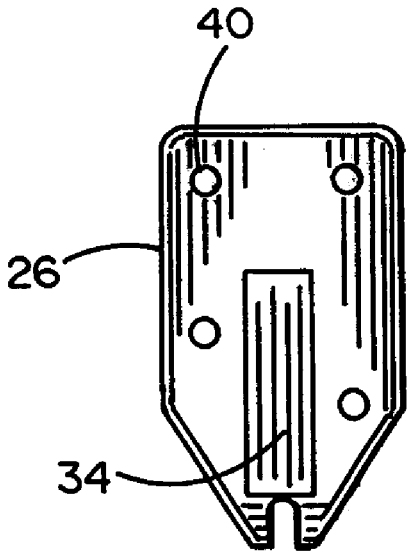
FIG. 5 is an elevational view of the inner surface of the rear face thereof.
Figure 6:
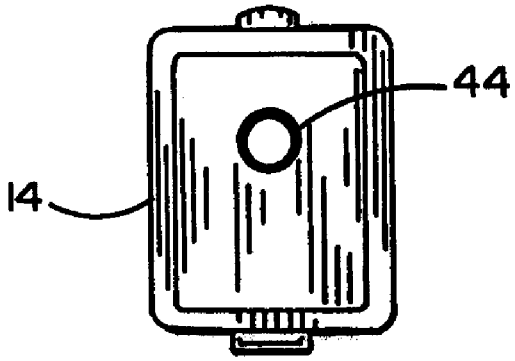
FIG. 6 is an elevational view of the rear of the ammunition cartridge with the rear face removed.
Figure 7:
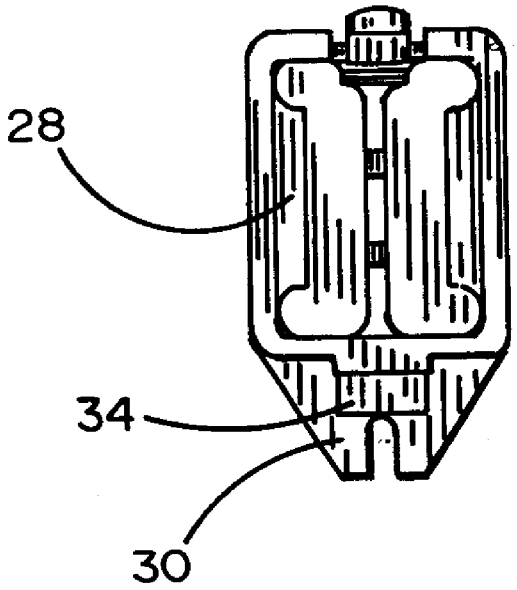
FIG. 7 is a front view of the ammunition cartridge.
Figure 8:
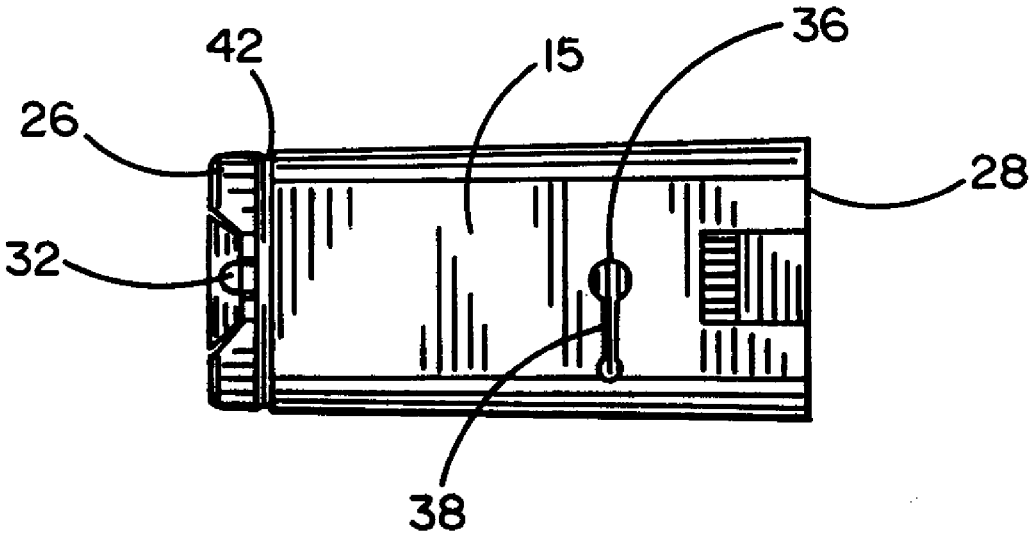
FIG. 8 is a bottom view of the ammunition cartridge.

The direct contact weapon 12 comprises a gripping portion 16 and a contact portion 18. Gripping portion 16 includes grip indentations 17 as well as an "on/off" switch 20 and a trigger switch 22. Also provided is a wrist strap 24. Contact portion 18 comprises a pair of contact probes 19 and a pair of discharge electrodes 21. When the weapon 10 is in the short range mode as shown in FIG. 3, probes 19 are used to contact two points on a nearby target to disable the target. The discharge electrodes 21 provide a safe discharge path while no target is contacted by probes 19.

Figure 1:
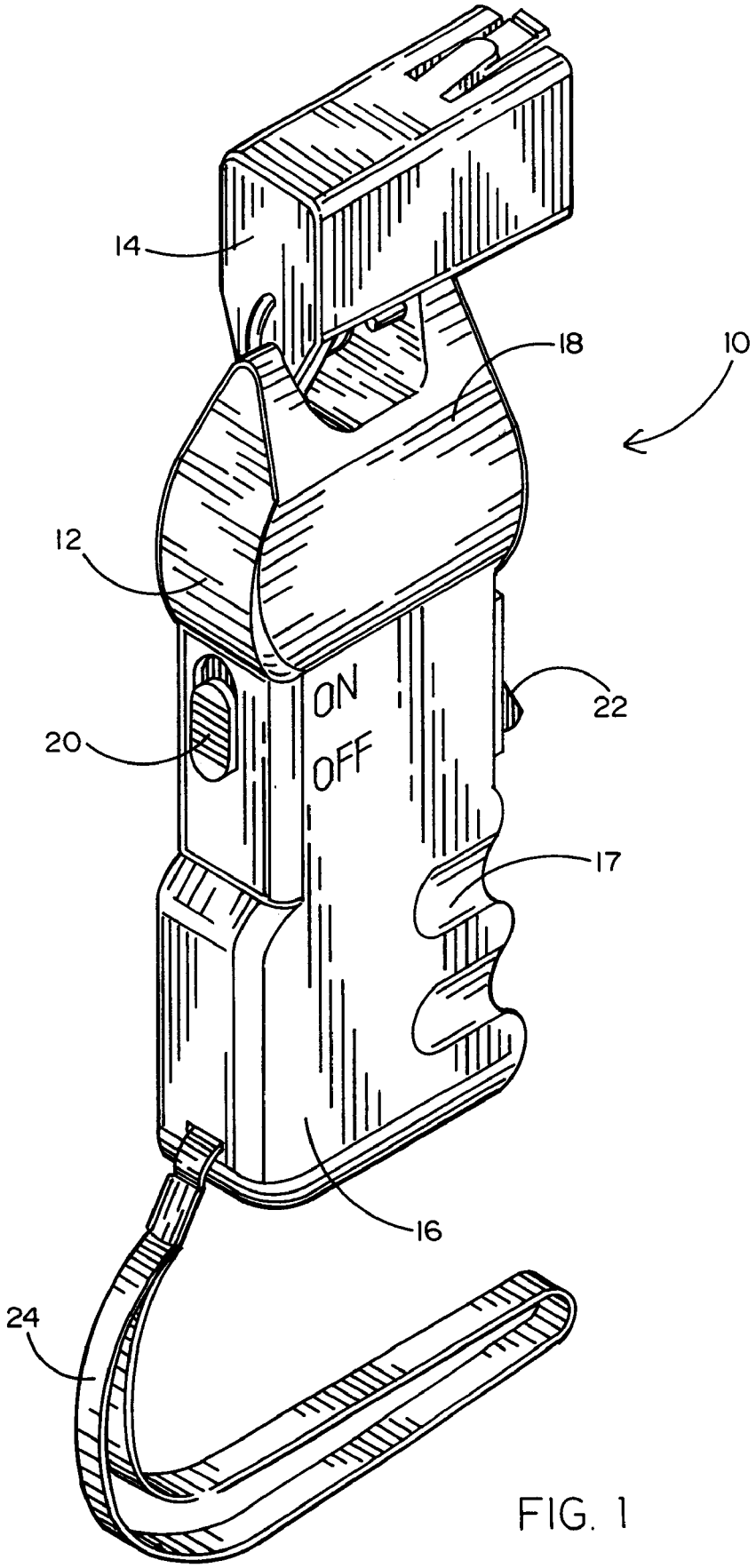
FIG. 1 is a three-dimensional illustration of the electrical discharge weapon of the invention.
Figure 2:
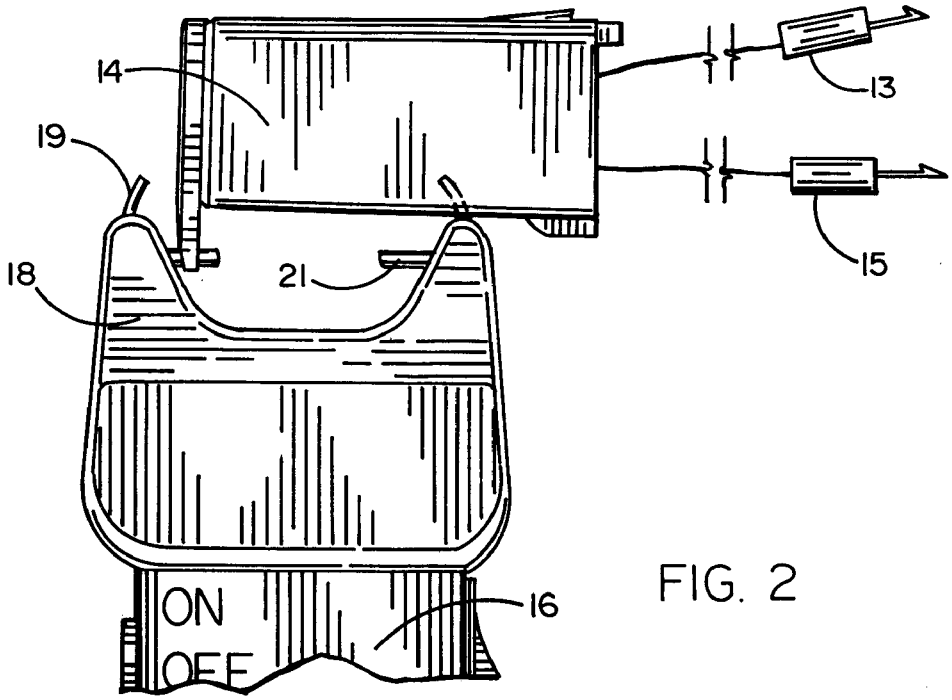
FIG. 2 is an elevational view of the upper portion of the invention with the unchambered ammunition cartridge thereof connected for long range operation.

When the cartridge 14 is connected to one probe 19 and to one discharge electrode 21 as shown in FIG. 2, the weapon 10 is configured for long range operation so that upon activation of the weapon by trigger switch 22, an electrical discharge is created within cartridge 14 and two wire-tethered darts 13 and 15 are explosively propelled out of cartridge 14 toward a remote target (not shown). The manner in which this remote target operation occurs, may be best understood by reference to FIGS. 4–8, which illustrate the unique structure of cartridge 14 which permits the cartridge to be added to the weapon. More specifically, cartridge 14 is a rectangular device which comprises a rear face 26 and a front face 28. Rear face 26 extends into an integral mounting bracket 30 having a groove 32 and an elongated electrical contact 34 which selectively connects a detonator 44 of cartridge 14 to discharge electrode 21 as shown in FIG. 2. Rear face 26 preferably has a plurality of standoff knobs 40 which form a narrow gap 42 between rear face 26 and cartridge 14 to permit rapid escape of gases at detonation without blowing out the rear face. Cartridge 14 has a bottom surface 15 having a hole 36 and an electrical contact 38. When cartridge 14 is mounted to weapon 10, hole 36 receives probe 19 which is in electrical connection with contact 38. Of course, it will be observed that probe 19 in electrical connection with contact 38, is of opposite polarity from discharge contact 21 which is in electrical connection with electrical contact 34. Therefore, when trigger switch 22 is activated, the cartridge is subjected to a high voltage discharge which propels the wire-tethered darts 13 and 15 to a remote target where the discharge voltage can disable that remote target. This may be accomplished in the present invention using an unchambered cartridge which requires no bulky structure to be accepted by weapon 10.

Thus it will be observed that by means of the inventive improvement herein disclosed, a conventional close proximity electrical discharge weapon may be readily modified to provide a long range, remote target disabling capability. Moreover, it will be observed that this convenient modification is accomplished with an unchambered cartridge which provides a streamlined configuration that avoids buildup and resulting misfiring. Those having skill in the relevant arts will now perceive various additions and modifications which may be made to the invention. By way of example, other ways for attachment of the cartridge to the assembly, will be readily apparent. Thus it is to be understood that the disclosed embodiment while presently being contemplated as the best mode of the invention is nevertheless only an exemplary illustration and not necessarily limiting of the scope hereof.

What is claimed is:

1. An ammunition cartridge for selective mechanical and electrical connection to a handheld close proximity electrical discharge weapon for converting the weapon for long range operation, the cartridge employing a pair of wire-tethered darts to be propelled at a remote target, the weapon having at least two contact probes and at least two discharge electrodes; the cartridge comprising:

means for mechanical and electrical connection to one of said at least two contact probes;

means for mechanical and electrical connection to one of said at least two discharge electrodes;

said one of said at least two contact probes and said one of said at least two discharge electrodes being of opposite electrical polarity upon activation of said weapon for detonating said ammunition cartridge.

2. The ammunition cartridge recited in claim 1 wherein said cartridge is unchambered.

3. The ammunition cartridge recited in claim 1 wherein said contact probe connection means comprises a hole in said cartridge said hole being in communication with an electrical contact.

4. The ammunition cartridge recited in claim 1 wherein said discharge electrode connection means comprises a cartridge face having an extended mounting bracket and an elongated electrical contact extending along a surface of said mounting bracket.

5. The ammunition cartridge recited in claim 4 wherein said mounting bracket terminates in a groove for receiving said discharge electrode in press fit engagement.

6. An electrical discharge weapon comprising:

a handheld close proximity discharge device having at least two contact probes and at least two discharge electrodes;

an ammunition cartridge for selective mechanical and electrical connection to said device for long range operation of said weapon; said cartridge having:

means for mechanical and electrical connection to one of said at least two contact probes;

means for mechanical and electrical connection to one of said at least two discharge electrodes;

said one of said at least two contact probes and said one of said at least two discharge electrodes being of opposite electrical polarity upon activation of said weapon for detonating said ammunition cartridge.

7. The weapon recited in claim 6 wherein said cartridge is unchambered.

8. The weapon recited in claim 6 wherein said contact probe connection means comprises a hole in said cartridge said hole being in communication with an electrical contact.

9. The weapon recited in claim 6 wherein said discharge electrode connection means comprises a cartridge face having an extended mounting bracket and an elongated electrical contact extending along a surface of said mounting bracket.

10. The weapon recited in claim 6 wherein said mounting bracket terminates in a groove for receiving said discharge electrode in press fit engagement.

11. A non-lethal weapon which can be used both against close proximity targets and against remote targets; the weapon comprising:

a hand-held close proximity electrical discharge device having at least two protruding conductive elements; and an unchambered ammunition cartridge having a pair of contacts for igniting a combustible charge for propelling wire-tethered electrodes toward a remote target;

said cartridge being selectively connectable mechanically to said device for placing said pair of contacts in proximity to said conductive elements so that activation of said device ignites said combustible charge.

* * * * *